US005554834A

United States Patent [19]

Ellett

[11] Patent Number: 5,554,834

[45] Date of Patent: Sep. 10, 1996

[54] PRESSURE SWITCH

[75] Inventor: James R. Ellett, Edmonton, Canada

[73] Assignee: Argus Machine Co. Ltd., Edmonton, Canada

[21] Appl. No.: 284,994

[22] Filed: Aug. 4, 1994

[51] Int. Cl.[6] ..... H01H 35/38

[52] U.S. Cl. ..... 200/82 A; 200/83 S

[58] Field of Search ..... 200/81 R, 82 R, 200/82 C, 82 A, 83 R, 83 A, 83 J, 83 P, 83 Q, 83 S, 83 SA, 83 W

[56] References Cited

U.S. PATENT DOCUMENTS

| | | | |
|---|---|---|---|
| 2,767,276 | 10/1956 | Buchanan et al. | 200/82 |
| 3,449,535 | 6/1969 | Otto et al. | 200/82 |
| 3,619,526 | 11/1971 | Riley | 200/83 J |
| 3,679,325 | 7/1972 | Yost | 417/17 |
| 4,503,301 | 3/1985 | Kurtz | 200/83 D |
| 4,900,883 | 2/1990 | Brame et al. | 200/83 S |
| 5,122,628 | 6/1992 | McLelland et al. | 200/83 Y |
| 5,243,158 | 9/1993 | Zimmermann | 200/83 J |

OTHER PUBLICATIONS

Camrose Electric Controls Ltd., Edmonton, Alberta, Canada, Parts RS73 Pressure Controls, 1 page, 1993.

Barber Industries Ltd., Edmonton, Alberta, Canada, Instructions for Installing and Operating High–Temp Presco–Switches, Type DHTE, Jan. 1992, 1 page.

*Primary Examiner*—Brian W. Brown
*Assistant Examiner*—Michael A. Friedhofer
*Attorney, Agent, or Firm*—Anthony R. Lambert

[57] ABSTRACT

A pressure switch has a housing with an interior bore extending from one end to the other. A rod slidable within the bore and operated by external fluid pressure extends between a piston at one end of the housing and a mechanically operated electrical switch at the other end of the housing. A spring is disposed about the rod between a first stop on the rod and a second stop on the housing. The spring provides resistance against movement of the rod under external pressure. The resistance of the spring to movement is adjusted by a sleeve engaging the spring, with the sleeve threaded into the bore of the housing for movement longitudinally within the housing. The sleeve includes plural radially extending slots disposed around the sleeve. A port in the housing allows access to the sleeve and a cover is provided for the port. The cover includes a ring disposed around the housing and threaded onto the housing over the port. The electrical switch is mounted on a block that has a central hold down screw passing through the switch mounting block and threaded longitudinally into the housing. A pair of jacking screws flank the central screw, are threaded into the housing and are received by screw receiving counterbores in the switch mounting block. Each of the jacking screws supports the switch mounting block in fixed relationship to the housing, with each of the screws being accessible from the second end of the housing through the screw receiving bores.

18 Claims, 5 Drawing Sheets

PRESSURE SWITCH

FIELD OF THE INVENTION

This invention relates to pressure switches.

BACKGROUND AND SUMMARY OF THE INVENTION

In the design of pressure switches, a rod slidable within a housing and movable by changes in external fluid pressure operates a plunger of a mechanically operated electrical switch. Resistance of the rod to movement, and hence the pressure at which the switch trips, is adjusted by a spring within the pressure switch that is biased against movement of the rod due to external fluid pressure. Adjustment of the compression on the spring changes the tripping pressure.

In one prior art pressure switch, model no. RS73 of Camrose Electric Controls Ltd. of Edmonton, Alberta, Canada, the spring is adjusted directly by a sleeve threaded onto the outside of the housing. As the sleeve moves along the outside of the housing, it compresses the spring by direct connection with the spring. This design, while it protects the inside of the housing from the environment, is prone to accidental movement of the sleeve, hence unintended changes in the tripping pressure.

In another prior art pressure switch, model DHTE of Barber Industries Ltd. of Edmonton, Alberta, Canada, the compression of the spring is adjusted by several wedges opposed to one another transverse to the direction of compression of the spring. As the wedges are moved towards each other by a screw abutting the end of one of the wedges, the longitudinal thickness of the combined wedges increases, thus compressing the spring. Again, with this device the adjustment mechanism is not enclosed and is susceptible to tampering.

The model DHTE of Barber also includes a mechanically operated pressure switch that is secured in place by a single screw, with the tripping point of the switch adjusted using a threaded piston rod inside a threaded trip plate. This trip point setting system is difficult to adjust.

The invention described and claimed here is intended to overcome the limitations of the known prior art. In one aspect of the invention, there is provided a pressure switch comprising a housing with an interior bore extending from one end to the other. A rod slidable within the bore and operated by external fluid pressure extends between a piston at one end of the housing and a mechanically operated electrical switch at the other end of the housing. A spring is disposed about the rod between a first stop on the rod and a second stop on the housing. The spring provides resistance against movement of the rod under external fluid pressure. The resistance of the spring to movement is adjusted by means disposed within the housing. A port in the housing allows access to the adjusting means and a cover is provided for the port. The cover preferably includes a ring disposed around the housing and threaded onto the housing over the port. The adjustment means preferably includes a sleeve engaging the spring, with the sleeve threaded into the bore of the housing for movement longitudinally within the housing. The sleeve includes plural radially extending slots disposed around the sleeve. Rotation of the sleeve changes the compression of the spring.

In a further aspect of the invention, the mechanically operated electrical switch is mounted on a switch mounting block by three cooperating screws. A central hold down screw passes through the switch mounting block and is threaded longitudinally into the housing. A pair of jacking screws flank the central screw and are threaded into the housing. Each of the jacking screws is received in a screw receiving counterbore in the switch mounting block to provide limit points for movement of the switch mounting block about the central hold down screw. Each of the screws is accessible from the second end of the housing, preferably through holes extending from the screw receiving counterbores.

The pressure switch may include a stop limiting movement of the cover away from the port, and may include a lock to prevent movement of the adjustment sleeve due for example to vibration of the pressure switch.

These and other aspects of the invention are described in the detailed description and claims that follow.

BRIEF DESCRIPTION OF THE DRAWINGS

There will now be described preferred embodiments of the invention, with reference to the drawings, by way of illustration, in which like numerals denote like elements and in which.

DETAILED DESCRIPTION OF PREFERRED EMBODIMENTS

Figure 1:
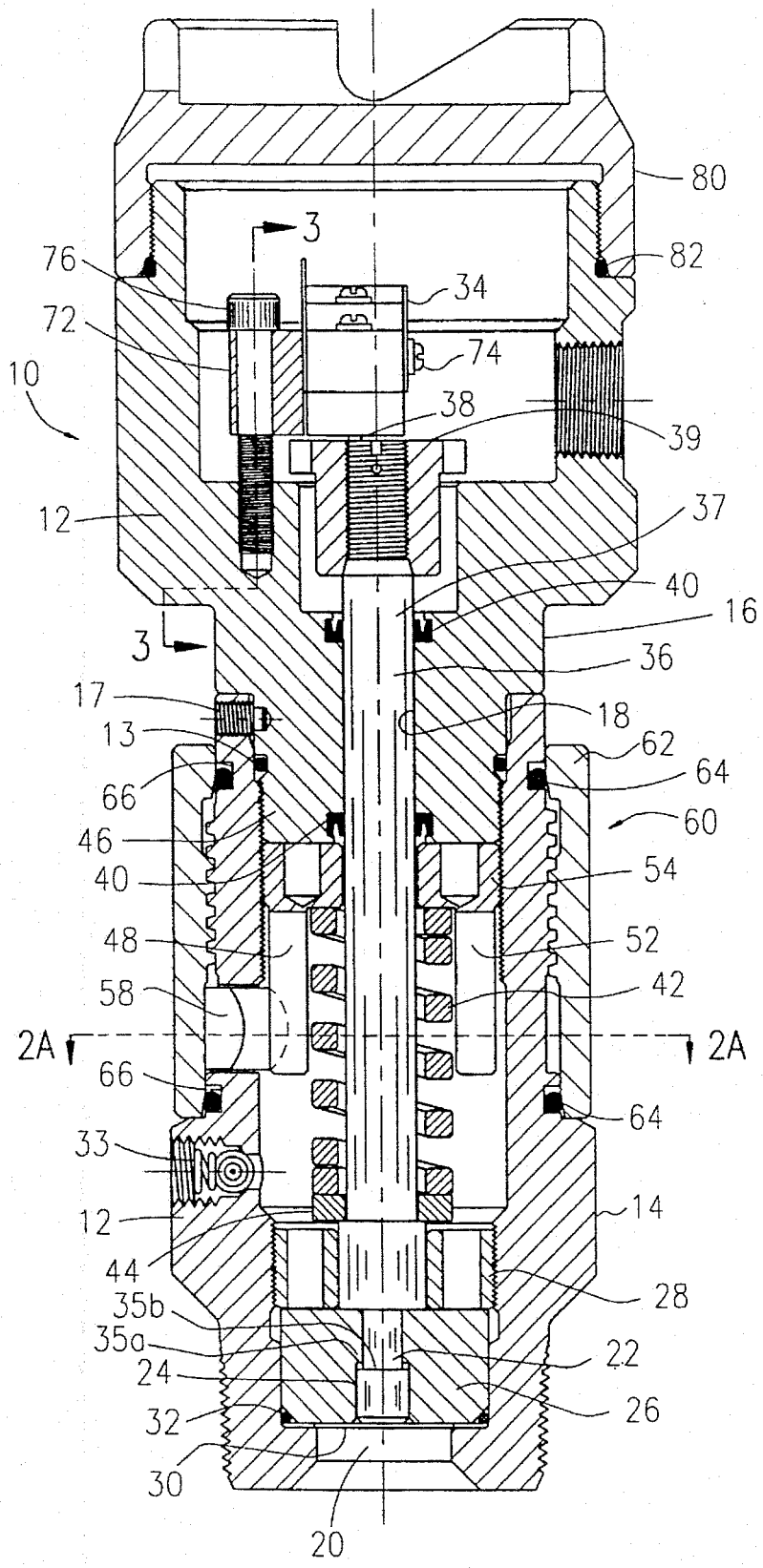
FIG. 1 is a longitudinal section through a pressure switch according to the invention.
Figure 2A:
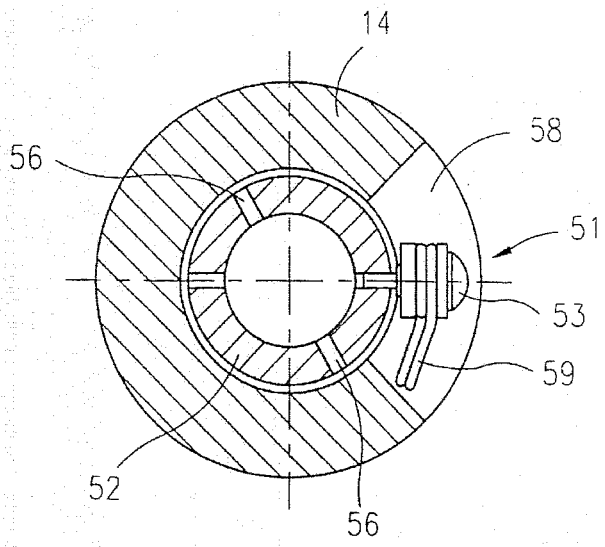
FIG. 2A is a cross-section through an adjustment sleeve for a pressure switch according to the invention showing an anti-vibration adjustment lock.

Referring to FIGS. 1 and 2A, there is shown a pressure switch 10 according to the invention. The pressure switch 10 is formed of a housing 12 having a first end 14 and a second end 16 threaded together and sealed with seals 13. Set screw 17 locks the first end 14 and second end 16 of the housing together. A bore 18 of variable inner diameter passes through the housing 12 from the first end 14 to the second end 16. In the bore 18 at the first end 14 is a piston 22 that is free to move longitudinally a limited amount within the bore 18. The piston 22 is shown here as including a piston head 24 snugly fitted in piston guide 26 at the first end 14 of the housing 12. The piston guide 26 is secured within the housing by a locking nut 28 threaded in the first end of the housing 12. End 20 of the bore 18 is sealed by diaphragm 30 that is held firmly within the end 14 by the piston guide 26 and sealed with O-ring seal 32 or a suitable alternative such as a gasket. Alternatively, the piston configuration may omit the diaphragm and use a sealed piston within a piston guide, but this configuration is more complicated in design and not preferred. The piston 22 abuts against the diaphragm 30 and assists in supporting it against collapse from external fluid pressure. Range of movement of the piston is limited by shoulder 35*a* on the piston guide 26 and by shoulder 35*b* on the piston 22. A bleed valve 33 releases pressure from within the bore 18 of the housing 12.

A mechanically operated electrical switch 34 (microswitch) is disposed at the second end 16 of the housing 12. A rod 36 is mounted slidably within the housing 12 and extends between the piston 22 and the mechanically operated electrical switch 34. By direct contact with the piston 22 and plunger 38 of the switch 34, the rod 36 is operatively connected to both the piston 22 and the switch 34, but this operative connection may be accomplished using intervening devices, with added complexity. The diaphragm 30, piston 22 and rod 36 function as a mechanism to transfer external fluid pressure along rod 36 to the mechanically operated electrical switch 34. The mechanically operated electrical switch (common in the art in itself) is operated by a plunger 38, which abuts against hub 39 threaded onto the end 37 of rod 36. Movement of the rod 36 and hub 39 in the direction from the first end of the housing 12 to the second end depresses the plunger 38 and activates the switch 34. The end 37 of the rod 36 is sealed within the bore 18 by elastomer seals 40.

A spring 42 is disposed about the rod 36 between a first stop 44 on the rod 36 and a second stop 46 forming part of the housing 12. The spring 42 provides resistance against movement of the rod 36 from the first end 14 of the housing 12 to the second end 16 of the housing 12. The spring 42 is preferably a compression spring, but may conceivably be in tension. The degree of resistance of the spring 42 to external fluid pressure on piston 22, hence movement of rod 36, is adjustable by adjustment means 48 encapsulated within the housing 12.

The adjustment means 48 includes a sleeve 52 surrounding and thus engaging one end of the spring 42. The sleeve 52 includes a threaded portion 54 threaded into the bore 18 of the housing 12 for movement longitudinally within the housing 12 by rotation of the sleeve 52. Referring in particular to FIG. 2A, plural radially extending slots 56 are disposed around the sleeve 52. The slots 56 may be of various shapes, but should be shaped to receive an implement, such as a screw driver, used to rotate the sleeve 52. A port 58 or opening in the housing 12 is provided and makes the adjustment means 48 accessible, for example by a screwdriver or other means for operating the adjustment means 48. A cover 60 for the port 58 is provided by a ring 62 disposed around the housing 12 and threaded onto the housing 12 over the port 58. The opposed ends of ring 62 are sealed against the housing 12 when the cover is in the closed position by O-ring seals 64 placed in grooves 66 formed in the housing 12. By unthreading the ring 62 towards the second end 16 of the housing 12, the port 58 is uncovered, allowing access to the adjustment means 48. Tightening of the cover 60 against the seals 64 ensures isolation of the adjustment means from the external environment.

Figure 2B:
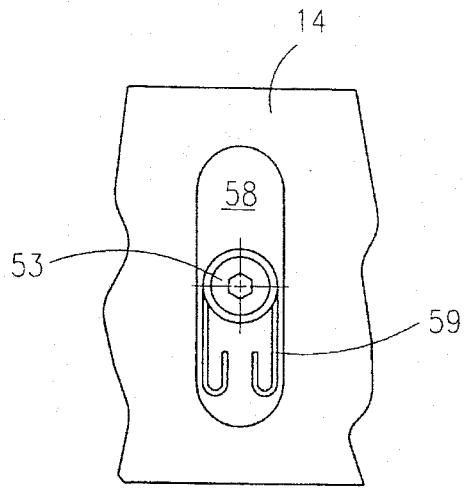
FIG. 2B is a side view of the anti-vibration adjustment lock of FIG. 2A.
Figure 2C:
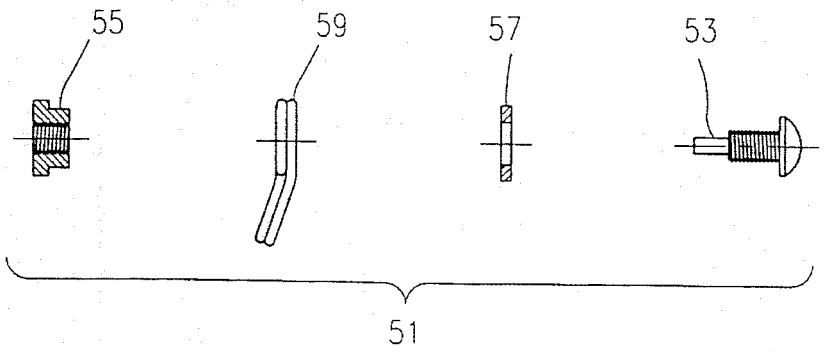
FIG. 2C is an exploded view of the anti-vibration adjustment lock of FIG. 2A.

Referring to FIGS. 2A, 2B and 2C, there is also provided an anti-vibration adjustment lock 51 for the pressure switch. The lock 51 resists rotational movement of the sleeve 52 within the first end 14 of the housing 12 that may occur due to vibration of the pressure switch in use. The lock 51 is formed by a retaining screw 53 threaded into a spring spool 55 with spring washer 57 and tension spring 59 secured on the shank of spring spool 55. The shank of screw 53 terminates in an unthreaded portion dimensioned to fit snugly within any of the slots 56. The tension spring 59 has laterally extending arms 59*a* that press against the sides of port 58, thus resisting rotational movement of the sleeve 52 and preventing rotation of the sleeve 52 more than one slot spacing.

At the second end 16 of the housing 12, the bore 18 is enlarged to receive the electrical switch 34. A switch mounting block 72 secures the electrical switch 34 in a fixed position. This fixed position of the electrical switch must be set carefully upon manufacture of the pressure switch so that travel of the rod 36 within its limited range of motion is sufficient to trip the plunger 38 of the electrical switch 34. The precise setting of the position of the mechanically operated electrical switch that is permitted by this design of the mounting block avoids the need for precise tolerances during manufacturing, which would be impractical to achieve.

Figure 3:
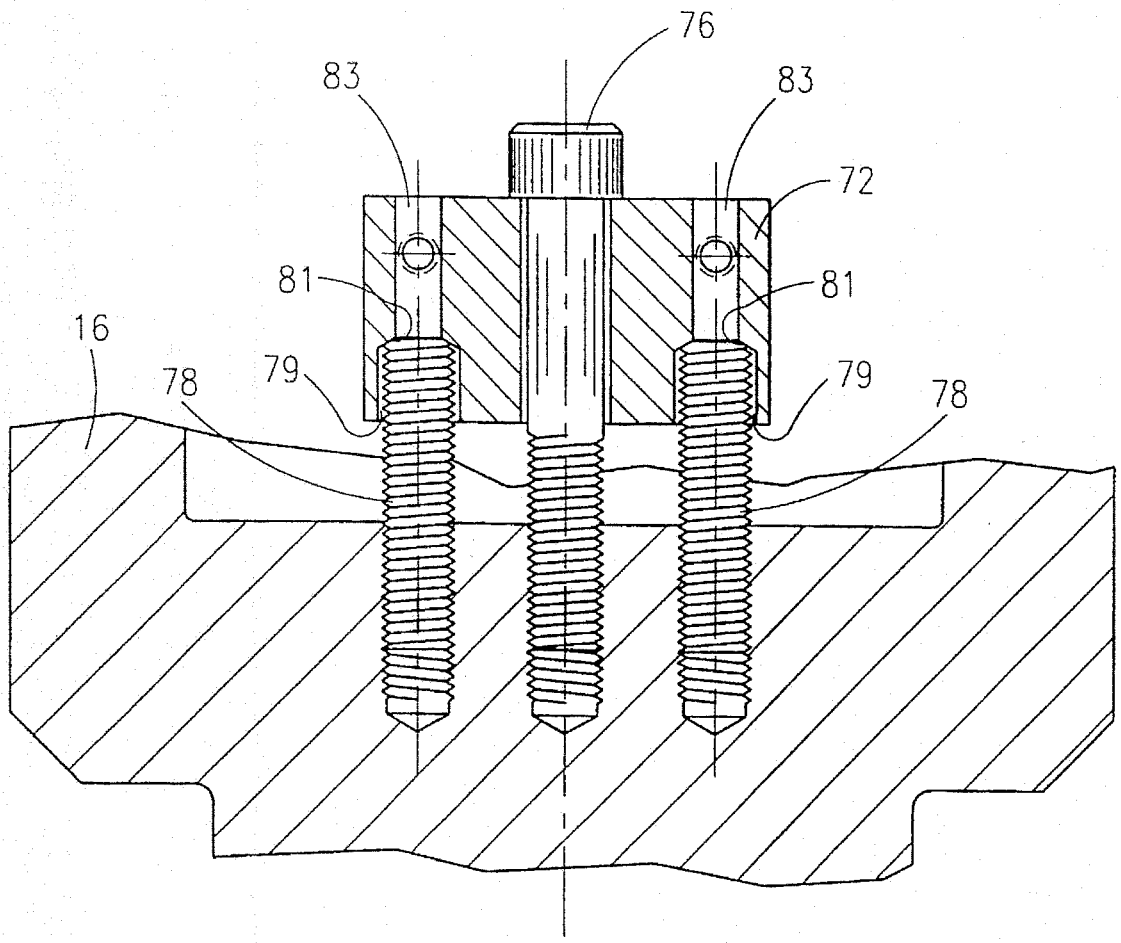
FIG. 3 is a cross-section through a switch mounting block for use with the pressure switch of FIG. 1.
Figure 4:
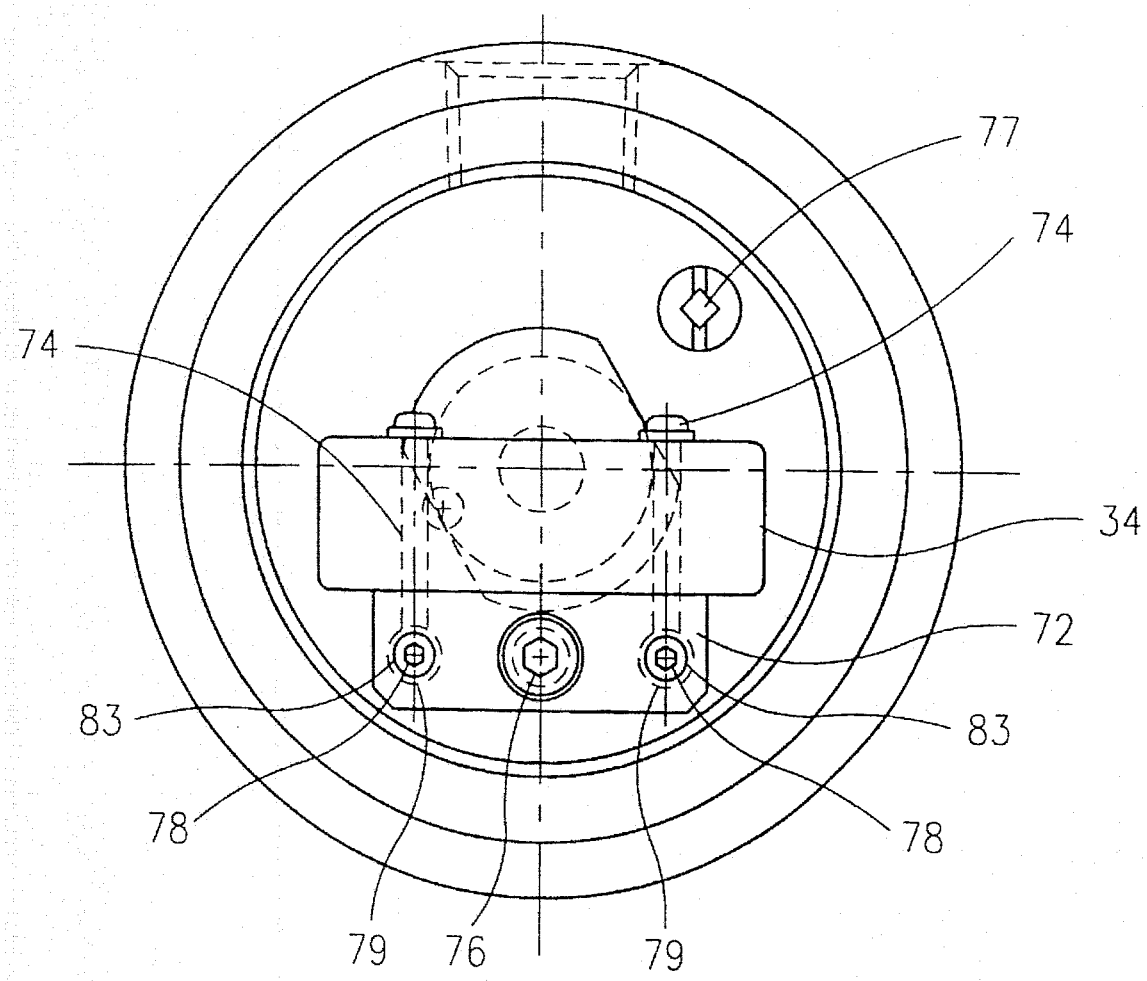
FIG. 4 is a top end view of the pressure switch of FIG. 1.

Referring in particular to FIGS. 3 and 4, the switch mounting block 72 includes a pair of transverse mounting screws 74 to secure the mechanically operated electrical switch 34 on the switch mounting block 72. A ground screw 77 is provided within the enlarged end 16 of the housing to provide a termination point for a grounding wire.

A central hold down screw 76 passes through the switch mounting block 72 and is threaded longitudinally into the second end 16 of the housing 12 towards the first end of the housing 14. A pair of jacking screws 78 flank the central screw 76 and are screwed into the second end of the housing 12. Each of the jacking screws 78 is received in a screw receiving counterbore 79 in the switch mounting block 72 whose shoulders 81 provide limit points for movement of the switch mounting block about the central hold down screw 76. Each of the screws 76, 78 is accessible for rotation from the second end 16 of the housing 12. Reduced diameter portions 83 of the bores 79 extend through the switch mounting block 72 thereby provided access to the jacking screws 78. The jacking screws 78 support the switch mounting block and relative adjustment of the jacking screws to each other permits accurate alignment of the switch mounting block. The height of the jacking screws 78 above the switch mounting block 72 establishes the tripping point of the mechanically operated electrical switch 34. The hold down screw 76 is not threaded into the switch mounting block and thus holds down and fixes the switch mounting block in relation to the jacking screws and therefore the housing. An end cap 80 threads onto the second end 16 of the housing 12 with O-ring seal 82 to enclose and secure within it the mechanically operated electrical switch 34.

Figure 5:
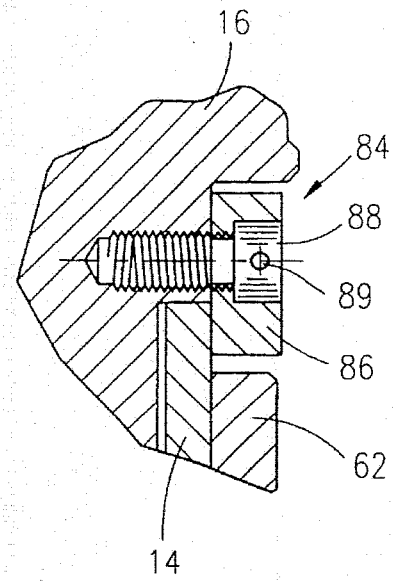
FIG. 5 is a side section through an adjustment access sealing assembly for use with the pressure switch of FIG. 1.
Figure 6:
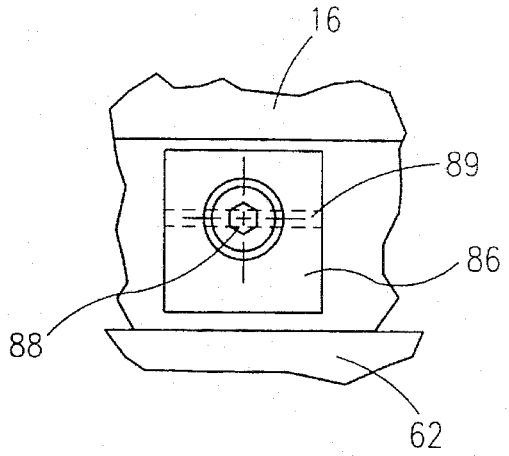
FIG. 6 is a side view of the adjustment access sealing assembly of FIG. 5.
Figure 7:
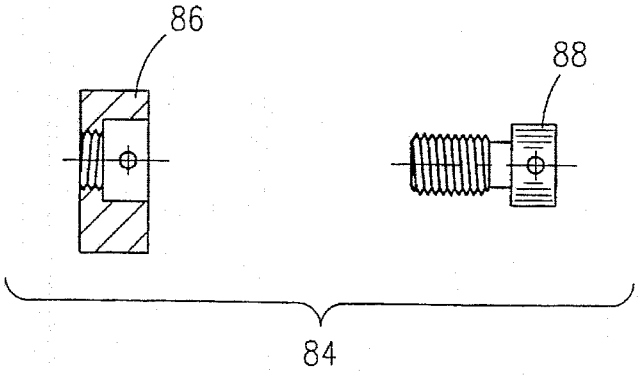
FIG. 7 is an exploded view of a holding block and screw for use with the adjustment access sealing assembly of FIG. 5.

Referring to FIGS. 5, 6 and 7, there is shown an adjustment access sealing assembly 84 that may be used as a stop to prevent the adjustment cover ring 62 from moving axially along the pressure switch. The assembly 84 is formed from a holding block 86 and holding screw 88. The holding block 86 is secured to the housing 16 by threading of the holding screw 88 through the holding block 86 into the housing 16 adjacent the cover ring 62. A sealing wire or cable (not shown) forming a seal can be inserted in cross bore 89 to prevent unauthorized removal of the holding screw 88 and the holding block 86. Any intrusion into the pressure switch will then be made apparent from the breaking of the seal.

Adjustment of the tripping pressure is as follows. The cover 60 is unthreaded, revealing the port 58. A screwdriver or like instrument is used to rotate the sleeve 52 and move it up or down in accordance with the direction of rotation, thus altering the compression of the spring. The pressure setting can be calibrated if desired with marks on the sleeve 52 or on the sides of the port 58 or on both the sleeve and the sides of the port 58. The rotational and hence axial location of the sleeve 52 may be secured by insertion of the anti-vibration adjustment lock 51 into one of the slots 56 with spring 59 biased against the sides of port 58. After adjustment of the sleeve 52, the cover may be threaded down over the port 58, thus securing the adjustment means against tampering. To further secure the adjustment means, the sealing assembly 84 may be threaded into the housing 16 to prevent axial movement of the cover ring 62 thus limiting movement of the cover away from the port and ensuring complete enclosure and sealing of the adjustment means 60.

A person skilled in the art could make immaterial modifications to the invention described and claimed in this patent without departing from the essence of the invention.

The embodiments of the invention in which an exclusive property or privilege is claimed are defined as follows:

1. A pressure switch comprising:

a housing with an interior bore and exterior threads;

a rod slidable over a limited range within the bore under external fluid pressure;

a mechanically operated electrical switch operatively connected to the rod;

adjustment means encapsulated within the housing to adjust resistance of the rod to movement under external fluid pressure;

a port in the housing for access to the adjustment means; and a removable cover for the port, the cover including a ring threaded onto and around the housing, and longitudinally movable on the exterior threads from a position away from the port to a position over the port.

2. The pressure switch of claim 1 further including seals on the housing for sealing the cover to the housing when the cover is over the port.

3. The pressure switch of claim 2 further including a stop limiting movement of the cover away from the port.

4. The pressure switch of claim 1 in which the adjustment means includes:

a spring opposed to movement of the rod under external fluid pressure;

a sleeve engaging the spring; and the sleeve being threaded into the bore of the housing for movement longitudinally within the housing to adjust compression on the spring.

5. The pressure switch of claim 4 in which the sleeve includes plural radially extending slots disposed around the sleeve.

6. The pressure switch of claim 4 further including a locking mechanism between the sleeve and housing to secure the sleeve against rotational movement.

7. The pressure switch of claim 1 further including:

a switch mounting block;

means to secure the mechanically operated electrical switch on the switch mounting block;

a central hold down screw passing through the switch mounting block and threaded longitudinally into the housing; and a pair of jacking screws parallel to and flanking the central screw and threaded into the housing, each of the jacking screws being received by respective screw receiving counterbores in the switch mounting block to support the switch mounting block in relation to the housing.

8. The pressure switch of claim 7 in which a reduced diameter portion of the screw receiving counterbores extend through the switch mounting block to allow access to the jacking screws.

9. A pressure switch comprising:

a housing with an interior bore and exterior threads;

a mechanically operated electrical switch disposed within the housing;

a pressure transfer mechanism exposed to external fluid pressure and operatively connected to the mechanically operated electrical switch;

adjustment means encapsulated within the housing to adjust resistance of the pressure transfer mechanism to movement under the external fluid pressure;

a port in the housing for access to the adjustment means; and a removable cover for the port, the cover including a ring threaded onto and around the housing, and longitudinally movable on the exterior threads from a position away from the port to a position over the port.

10. The pressure switch of claim 9 further including seals on the housing for sealing the cover to the housing when the cover is over the port.

11. The pressure switch of claim 9 in which the pressure transfer mechanism includes a rod, and a piston movable in housing under external fluid pressure and the adjustment means includes:

a spring opposed to movement of the rod under external fluid pressure;

a sleeve engaging the spring; and the sleeve being threaded into the bore of the housing for movement longitudinally within the housing.

12. The pressure switch of claim 11 in which the sleeve includes plural radially extending slots disposed around the sleeve.

13. The pressure switch of claim 11 in which the rod is slidable within the housing and operatively connected to the piston and the mechanically operated electrical switch; and the spring is disposed about the rod between a first stop on the rod and a second stop on the housing, the spring providing resistance against movement of the rod from the first end of the housing to the second end of the housing.

14. The pressure switch of claim 9 further including:

a switch mounting block;

means to secure the mechanically operated electrical switch on the switch mounting block;

a central hold down screw passing through the switch mounting block and threaded longitudinally into the housing; and a pair of jacking screws flanking the central screw and threaded into the housing, each of the jacking screws being received by respective screw receiving counterbores in the switch mounting block to support the switch mounting block in relation to the housing.

15. The pressure switch of claim 14 in which a reduced diameter portion of the screw receiving counterbores extend through the switch mounting block to allow access to the jacking screws.

16. A pressure switch comprising:

a housing with an interior bore;

a mechanically operated electrical switch disposed within the housing;

a pressure transfer mechanism exposed to external fluid pressure and operatively connected to the mechanically operated electrical switch;

adjustment means to adjust resistance of the pressure transfer mechanism to movement under the external fluid pressure;

a switch mounting block encapsulated within the housing;

means to secure the mechanically operated electrical switch on the switch mounting block;

a central hold down screw passing through the switch mounting block and threaded longitudinally into the housing; and a pair of jacking screws parallel to and flanking the central screw and threaded into the housing, each of the jacking screws being received by respective screw receiving counterbores in the switch mounting block to support the switch mounting block in relation to the housing.

17. The pressure switch of claim 16 in which the screw receiving counterbores extend through the switch mounting block to allow access to the jacking screws.

18. The pressure switch of claim 16 in which the adjustment means is encapsulated within the housing and accessible through a removable cover.

* * * * *